United States Patent [19]

Gorman et al.

[11] 4,386,249

[45] May 31, 1983

[54] VACUUM CIRCUIT INTERRUPTER WITH AUXILIARY CONTACT FOR PLURAL ARC PATH DEVICE WITH ARC ROTATING MEANS ASSOCIATED WITH THE PRIMARY AND AUXILIARY CONTACTS

[75] Inventors: Joseph G. Gorman, Murrysville; James F. Roach, Oakmont, both of Pa.

[73] Assignee: Westinghouse Electric Corp., Pittsburgh, Pa.

[21] Appl. No.: 210,429

[22] Filed: Nov. 25, 1980

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,976,382 | 3/1961 | Lee | 200/144 B |
| 3,014,109 | 12/1961 | Burger | 200/144 B |
| 3,185,797 | 5/1965 | Porter | 200/144 B |
| 3,185,798 | 5/1965 | Titus | 200/144 B |
| 3,185,799 | 5/1965 | Greenwood et al. | 200/144 B |
| 3,372,258 | 5/1968 | Porter | 200/144 B |
| 3,471,733 | 10/1969 | Rich | 200/144 B |
| 3,509,404 | 4/1970 | Rich | 200/144 B |
| 3,612,795 | 10/1970 | Emmerich | 200/144 B |
| 3,836,740 | 9/1974 | Hundstad | 200/144 B |

FOREIGN PATENT DOCUMENTS

| | | | |
|---|---|---|---|
| 45-5089 | 2/1970 | Japan | 200/144 B |
| 1093231 | 11/1967 | United Kingdom | 200/144 B |

*Primary Examiner*—Robert S. Macon

*Attorney, Agent, or Firm*—W. G. Sutcliff

[57] ABSTRACT

A vacuum circuit interrupter with primary cup shaped arcing contacts with integral means for arc movement. An auxiliary, generally cylindrical arc contact is spaced about the primary contacts by a dimension less than the spacing between the opened primary contacts. The auxiliary contact includes means for moving the auxiliary path arcs which are formed between the auxiliary contact and the primary contacts with extinguishment of the arc between the primary contacts.

7 Claims, 7 Drawing Figures

VACUUM CIRCUIT INTERRUPTER WITH AUXILIARY CONTACT FOR PLURAL ARC PATH DEVICE WITH ARC ROTATING MEANS ASSOCIATED WITH THE PRIMARY AND AUXILIARY CONTACTS

BACKGROUND OF THE INVENTION

The present invention relates to vacuum circuit interrupters used for electrical power distribution. Such devices are used to carry high currents during normal closed switch contact operation, and to interrupt this current flow by opening the contacts in a vacuum. These vacuum circuit interrupters are designed for reliable, reusable operations in for example 40 kiloamps at 38 kilovolt systems. The current carrying contacts must be designed to have the capacity of handling such large currents, yet be able to interrupt this current when the contacts are separated without restriking of the arc with such high voltages across the contacts.

The formation of an anode spot and the anode contact melting associated with it constitutes the fundamental plysical mechanism which limits the high current interruption capability for vacuum circuit interrupters. The simple planar butt type contact, even with very large diameter contacts, has been found ineffective to interrupt such high currents and voltages.

A variety of contact structures have been tried in the prior art to move or rotate the formed arc to avoid anode spot formation, or at least to move the spot over the anode surface to minimize anode melting. These structures range from forming the contacts with spiral arms to forming cup-shaped contacts with slotted arc surface rims as in U.S. Pat. No. 4,149,050. The use of an axial magnetic field parallel to the arc path has been found to maintain the arc in a more diffuse mode than would otherwise be the case for the same current levels without the axial magnetic field.

The use of an auxiliary arcing electrode about the two primary electrodes to provide a plural arc gap path is taught by U.S. Pat. No. 3,612,795.

It is desirable to provide a vacuum circuit interrupter with a contact structure that carries high operating current with minimum losses and can reliably interrupt high current at high voltage without restriking or eroding the contacts.

SUMMARY OF THE INVENTION

A vacuum circuit interrupter is provided with cup-shaped primary electrical contacts and a generally cylindrical auxiliary arcing contact disposed about and spaced a predetermined distance from the primary contacts. The primary contacts are generally cup-shaped members with a planar base portion and an annular contactor portion extending from the base portion toward the opposed contactor. The primary contacts include integral means for rotating the arc which forms between the annular contactor portions when they are moved apart. Such rotating means also forces the arc outward so that when the gap between the primary contacts exceeds the gap between the auxiliary contact and the primary contact, an arc forms between the auxiliary contact and each of the primary contacts.

The auxiliary contact is either a thick walled or a double walled cylindrical member including means for rotating the auxiliary path arcs formed between the auxiliary contact and the primary contacts.

DESCRIPTION OF THE PREFERRED EMBODIMENT

The present invention has numerous embodiments as will be described in reference to FIGS. 1–6.

Figure 1:
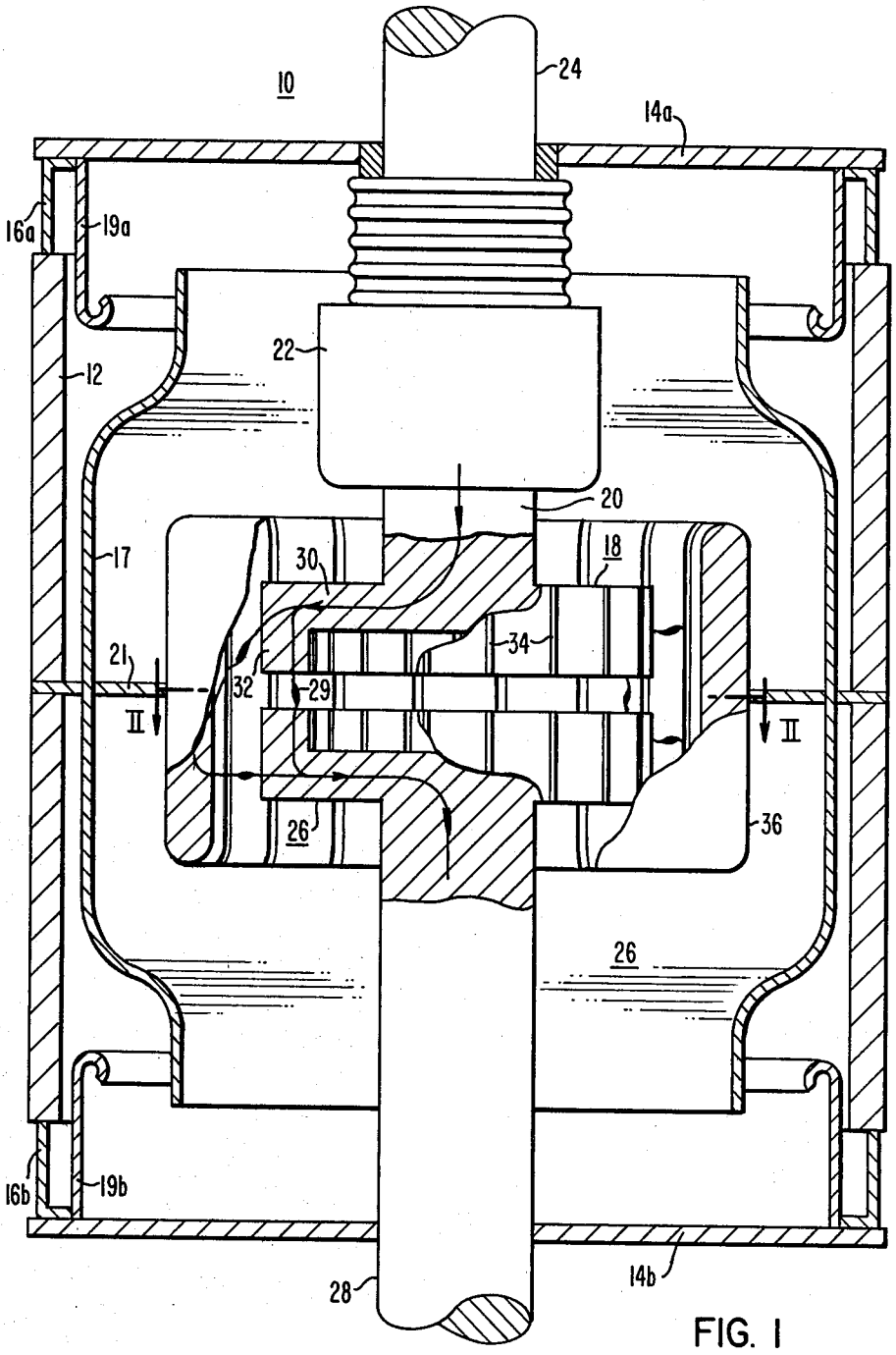
FIG. 1 is an elevational view, partly in section of an embodiment of the present vacuum circuit interrupter.

In FIG. 1, the vacuum circuit interrupter 10 includes a generally cylindrical envelope 12 with end plates 14*a*, 14*b*, sealed to opposite ends of the envelope 12 via end seal members 16*a*, 16*b*, respectively.

A generally cylindrical center arc shield 17 is disposed within the interrupter 10 coaxial within the envelope 12. An end shield 19*a*, 19*b* which is also generally cylindrical is disposed from the respective end plates 14*a* and 14*b* to protect the seal areas at members 16*a*, 16*b* from hot contact particles which may erode or evolve from the interrupter contacts during contact opening.

A movable primary electrical contact 18 is supported from conductive support rod 20 and bellows 22 which is sealed to end plate 14*a* with external conductor 24. A fixed primary electrical contact 26 is supported from conductive support rod 28 which is sealed through end plate 14*b*. The primary contacts 18 and 26 are shown in the open circuit, spaced apart position in FIG. 1, with primary arc 29 illustrated between these contacts.

Each of the primary electrical contacts 18 and 26 are cup-shaped members having a planar base portion 30 and an annular contactor portion 32 extending from the base portion 30 toward the opposed contactor. A plurality of angled slots 34 are provided in the annular contactor portion 32 as integral means for rotating the primary gap arc which forms between annular contactor portions upon initial movement of the primary contacts away from each other during current interruption.

An auxiliary cylindrical contact 36 is disposed about the primary contacts 18 and 26. The auxiliary contact 36 is supported from the center arc shield via support means 21 which preferably is an insulating support. This auxiliary contact 36 is spaced radially from the primary contacts by an auxiliary gap distance which is about one-half the primary gap distance when the primary contacts are fully moved apart in open circuit position. This ensures that the primary gap arc 29 will be extinguished, and a pair of auxiliary path arcs 37*a* and 37*b* will form between the auxiliary contact and the respective primary contacts. These auxiliary gap arcs will in effect be in electrical series.

A plurality of angled slots 38 are provided in the auxiliary contact 36 inner wall surface 39 as means for rotating the auxiliary path arcs which are formed.

The arc rotating means associated respectively with the primary contacts and the auxiliary contacts ensure against any anode spot being formed or maintained at one location on a contact surface.

Figure 2:
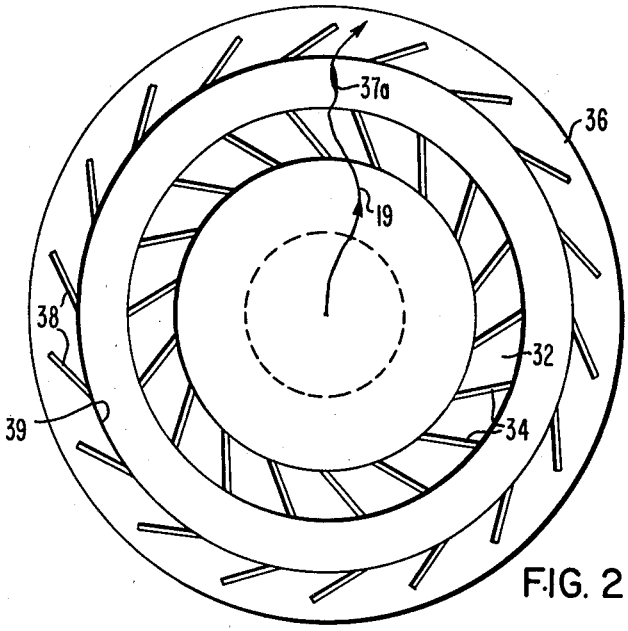
FIG. 2 is a view along line A—A of FIG. 1 to show one primary contact and the auxiliary contact.
Figure 3:
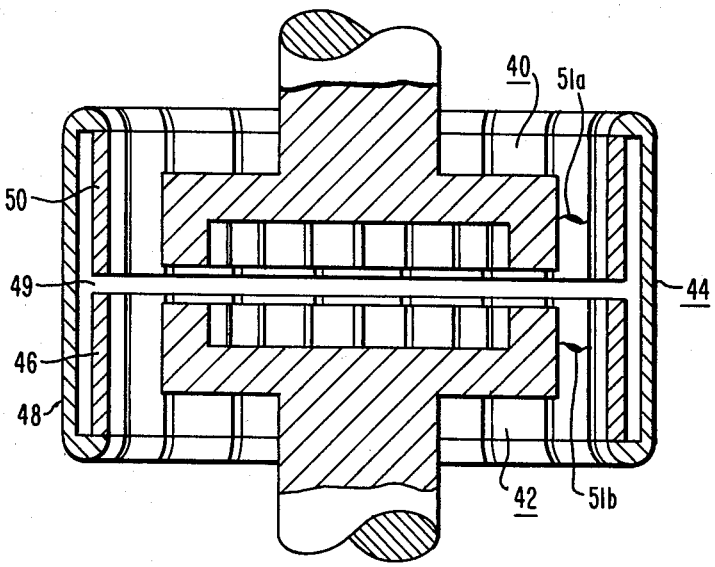
FIG. 3 is a side elevational representation partly in section of the primary contacts and auxiliary contact of another vacuum circuit interrupter embodiment.

In the embodiment seen in FIG. 3, the primary contacts 40, 42 are the same as described in the FIGS. 1 and 2 embodiment. The auxiliary contact 44 of the FIG. 3 embodiment has a double walled cylinder structure with inner wall 46 and outer wall 48 connected at their respective extending end portions. A central annular gap 49 is defined in the inner wall 46. The inner wall 46 has a plurality of angled slots 50 through such inner wall 46, to serve as means for rotating the auxiliary path arcs 51*a*, 51*b* which form between the respective primary contacts and the inner wall portion about the respective primary contact. The gap in the inner wall insures that the arcs are not driven off the auxiliary contact, with the outer wall portion 48 acting as a return current path.

Figure 4:
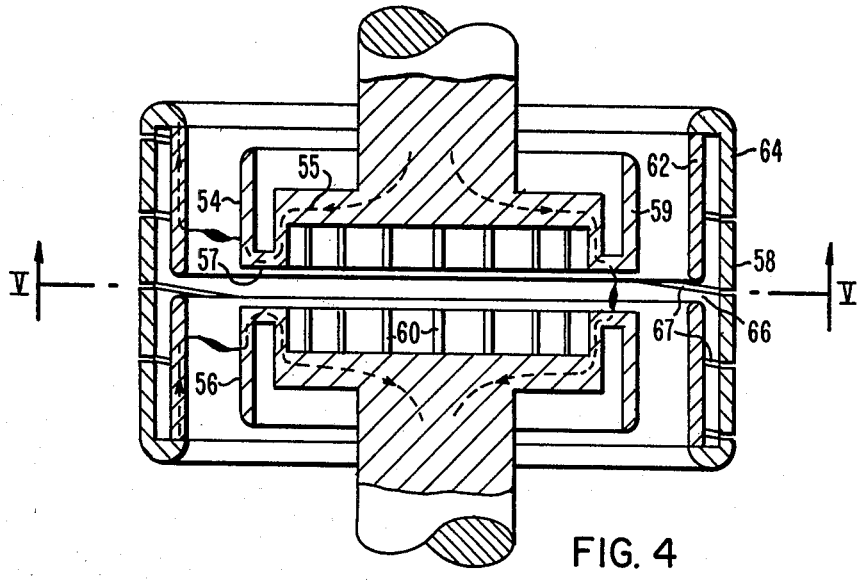
FIG. 4 is a side elevational representation partly in section of yet another embodiment of the primary and auxiliary contacts.
Figure 5:
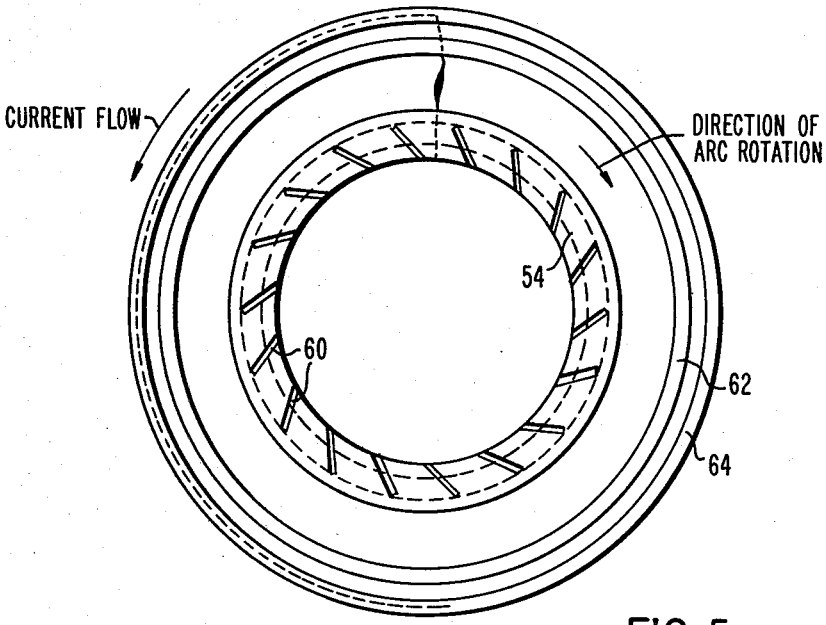
FIG. 5 is a view along line B—B of FIG. 4.

In the embodiment of FIGS. 4 and 5, the primary contacts 54, 56 are again cup-shaped contacts, with a planar base portion 55, an annular contact portion 57, and an annular auxiliary arcing portion 59 which extends back from annular contact portion 57 back beyond the planar base portion 55 along a substantial portion of the generally cylindrical double-walled auxiliary contact 58. A plurality of slots 60 are provided in the contact face of the annular contact portion 57, which slots 60 extend from the inner perimeter only part way through the annular contact portion, but does not go completely through to the outer perimeter of contact portion 57 where it extends into annular auxiliary arcing portion 59. This enlarged annular auxiliary arcing portion 59 provides a large surface for arcing to the auxiliary contact 58. The auxiliary contact 58 has an inner wall 62 and outer wall 64 which are connected at their respective extending end portions. An annular gap 66 is centrally formed in the inner wall 62. The outer wall 64 has a helical slot 67 cut therein to provide a helical current path about the interrupter longitudinal axis to produce an axial magnetic field which is effective to keep the primary gap arc diffuse, and to rotate the auxiliary gap arcs.

Figure 6:
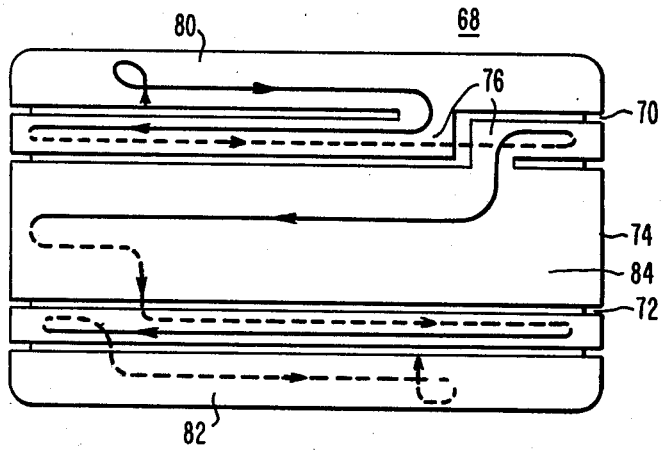
FIG. 6 is an elevational representation of the auxiliary contact of yet another embodiment.

FIG. 6 illustrates another embodiment in which the primary contacts are not seen, but are as per the contacts in FIGS. 4 and 5, with an auxiliary contact 68 in which a plurality of circumferential slots 70, 72 are formed in the outer wall 74 of the double walled contact 68 to define coil turn portions. The coil turns are connected via bridging connections 76 across the slots 70, 72 to provide electrical connection between end coil portions 80, 82, and center coil portion 84. When an auxiliary path arc current is established between the primary contacts and the interior of the auxiliary contact 68, the current flows in the plural turn coil provided by this structure to produce the axial magnetic field which causes the arcs to rotate.

Figure 7:
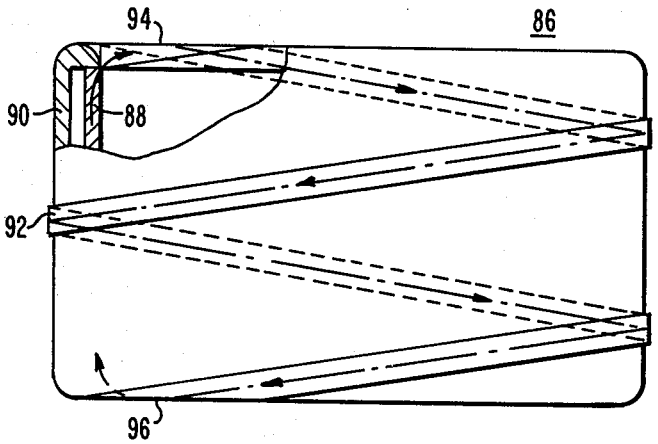
FIG. 7 is an elevational representation, partly in section, of another auxiliary contact embodiment.

In another embodiment seen in FIG. 7, the primary contacts are not seen, but are the same as in the FIGS. 4 and 5 embodiment. The auxiliary contact 86 again comprises a double walled cylindrical member with inner wall 88, and outer wall 90. The outer wall 90 is formed of a relatively higher resistance material and a helical coil 92 of low resistivity is wrapped about and supported from outer wall 90. The opposed ends 94, 96 of this coil 92 are electrically connected to high conductivity inner wall 88 at its opposed ends. In this way, the auxiliary path arc current flows through inner wall 88 and the coil 92 to produce an axial magnetic field which tends to rotate the arcs.

We claim:

1. A vacuum circuit interrupter comprising a hermetically sealed, evacuated cylindrical envelope having sealed end members, with conductive support rods extending therefrom within the envelope and supporting opposed primary electrical contacts which are movable relative to each other to carry current when the primary contacts are closed in electrical contacting relationship and between which primary contacts an arc forms upon movement of the primary contacts to open circuit spaced apart relationship, which primary electrical contacts are generally cup-shaped members with a planar base portion and an annular contactor portion extending from the base portion toward the opposed contactor, which primary contacts include integral means comprising a plurality of angled slots formed in the annular contactor portion for rotating the arc which forms between the annular contactor portions when the contactor portions are moved apart, an auxiliary cylindrical contact disposed spaced about the primary contact pair so that when the contactor portions of the primary contacts are spaced apart greater than the spacing between the auxiliary contact and the respective primary contacts and auxiliary path arc forms between the annular contactor portion of respective primary contacts and the auxiliary contact and the primary path arc is extinguished, and wherein the auxiliary contact includes integral means comprising a plurality of angled slots formed in the auxiliary cylindrical contact, which angled slots extend along substantially the full longitudinal extent of the auxiliary cylindrical contact for rotating the auxiliary path arcs formed between the auxiliary contact and the primary contact.

2. The device set forth in claim 1, wherein the annular contactor portion of the primary contacts extends along a substantial portion of the auxiliary contact to provide increased arcing surface area, and annular grooves are provided between the base portion and the annular contactor portion.

3. A vacuum circuit interrupter comprising a hermetically sealed, evacuated cylindrical envelope having sealed end members, with conductive support rods extending therefrom within the envelope and supporting opposed primary electrical contacts which are movable relative to each other to carry current when the primary contacts are closed in electrical contacting relationship and between which primary contacts an arc forms upon movement of the primary contacts to open circuit spaced apart relationship, which primary electrical contacts are generally cup-shaped members with a planar base portion and an annular contactor portion extending from the base portion toward the opposed contactor, which primary contacts include integral means for rotating the arc which forms between the annular contactor portions when the contactor portions are moved apart, an auxiliary cylindrical contact disposed spaced about the primary contact pair so that when the contactor portions of the primary contacts are spaced apart greater than the spacing between the auxiliary contact and the respective primary contacts an auxiliary path arc forms between the annular contactor portion of respective primary contacts and the auxiliary contact and the primary path arc is extinguished, and wherein the auxiliary contact includes integral means for rotating the auxiliary path arcs formed between the auxiliary contact and the primary contact, and the auxiliary contact comprises a double-walled cylindrical member.

4. The device set forth in claim 3, wherein a central annular gap is provided in the inner wall of the double walled cylindrical contact.

5. The device set forth in claim 3, wherein the auxiliary contact includes helical slots in the outer wall of the double walled cylinder to provide a helical current path to produce an axial magnetic field along the device longitudinal axis.

6. The device set forth in claim 3, wherein the auxiliary contact means to promote auxiliary path arc rotation comprises a plurality of circumferential slots formed in the outer wall cylinder portion to define coil turn portions with bridging connections between adjacent coil turns so that a plural turn circumferential current path is formed by the outer cylinder portion to generate an axial magnetic field.

7. The device set forth in claim 3, wherein the auxiliary contact means to promote auxiliary path arc rotation comprises a high conductivity helical coil wrapped about and supported by the outer wall of the auxiliary contact, which outer wall is formed of a low conductivity material, and wherein the helical coil ends are electrically connected to the inner wall portion of the auxiliary contact at the respective opposite ends thereof.

* * * * *